US006719619B2

(12) United States Patent
Kuo et al.

(10) Patent No.: US 6,719,619 B2
(45) Date of Patent: Apr. 13, 2004

(54) QUICK COUPLER FOR MOUNTING A ROTATIONAL DISK

(75) Inventors: Ching-Hui Kuo, Shindian (TW); Jheng-Tong Wu, Changhua (TW); Chih-Hsien Chang, Banchiau (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 375 days.

(21) Appl. No.: 09/846,641

(22) Filed: May 1, 2001

(65) Prior Publication Data

US 2002/0164939 A1 Nov. 7, 2002

(51) Int. Cl.[7] ..... B24B 1/00

(52) U.S. Cl. ..... 451/443; 451/285; 279/75; 279/46.1

(58) Field of Search ..... 451/41, 285, 287, 451/288, 443, 56; 279/75, 76, 40, 79, 46.1; 285/268

(56) References Cited

U.S. PATENT DOCUMENTS 3,589,673 A * 6/1971 Cruse ..... 251/149.9
5,941,891 A * 8/1999 Walen ..... 606/167
6,139,440 A * 10/2000 Taylor ..... 476/131
6,293,559 B1 * 9/2001 Harman, Jr. et al. ..... 279/75
6,527,621 B1 * 3/2003 Halley ..... 451/5

* cited by examiner

*Primary Examiner*—Eileen P. Morgan
(74) *Attorney, Agent, or Firm*—Tung & Associates

(57) ABSTRACT

A quick coupler for mounting a rotational disk which enables the rotational disk to be quick connect to or disconnect from a pad conditioner disk holder is disclosed. The quick coupler consists of two major components of a disk holder and a travel housing. The disk holder is formed in a ring shape having a center aperture in a polygon shape for intimately engaging a polygon-shaped shaft of the travel housing such that a rotational torque can be transmitted from the travel housing to the disk holder. Each side of the polygon is provided with a steel ball and a recessed slot behind the ball for receiving a jutting key operated by a retractable ring attached to the travel housing. The travel housing is formed in a cylindrical shape that has a first end threaded for engaging a drive means and a second end in the polygon shape.

16 Claims, 4 Drawing Sheets

QUICK COUPLER FOR MOUNTING A ROTATIONAL DISK

FIELD OF THE INVENTION

The present invention generally relates to an apparatus of a quick coupler for mounting a rotational disk and more particular, relates to an apparatus of a quick connect/disconnect coupler for mounting a rotational disk member equipped with a diamond disk into a pad conditioner disk holder assembly.

BACKGROUND OF THE INVENTION

Apparatus for polishing thin, flat semi-conductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 20 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel.

The polishing pad is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing" wherein the surface of a polishing pad becomes smooth such that the pad no longer holds slurry in-between the fibers. This is a physical phenomenon on the pad surface not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, re-open the pores, and thus forms micro-scratches in the surface of the pad for improved life time. The pad conditioning process can be carried out either during a polishing process, i.e. known as concurrent conditioning, or after a polishing process.

A conventional conditioning disc for use in pad conditioning is shown in FIG. 1C in a perspective view of a CMP apparatus 50. The apparatus 50 consists of a conditioning head 52 which includes a conditioning disc 68 mounted to a hub frame 70, a polishing pad 56, and a slurry delivery arm 54 positioned over the polishing pad. The conditioning head 52 is mounted on a cover ring 58 which is extended over the top of the polishing pad 56 for making sweeping motion across the entire surface of the pad. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process.

FIG. 2 shows a cross-sectional view of the conditioning head 52 of FIG. 1C. The conditioning head 52 is constructed by a bearing mount 42, a ball-bearing 44, a cylinder rotator 46, and a cylinder shaft 48. The bearing mount 42 and the ball-bearings 44 are mounted stationarily, while the cylinder rotator 46 and the cylinder shaft rotate when driven by a pulley 50. A pneumatic conduit 52 is utilized to supply a pressure onto the cylinder shaft 48 such that a conditioning disk 54 is pushed downwardly onto the surface of a polishing pad to be conditioned. The pneumatic conduit 52 further supplies a negative pressure, i.e. a vacuum onto the cylinder shaft 48, when the conditioning motion of the conditioning disk 54 is to be stopped and that the conditioning disk 54 is to be disengaged from the surface of the polishing pad. An elastomeric diaphragm 56 is used to provide a fluid seal between the cylinder shaft 48 and the cylinder rotator 46 to prevent the back flow of polishing slurry into the pneumatic conduit 52.

In the conventional design of the polishing head shown in FIG. 2, numerous design deficiencies have been discovered which lead to serious processing difficulties. For instance, a one-piece travel housing 30 is mounted inside the cylinder shaft 48 for connecting the conditioning disk 54 to the flat end 32 and for connecting to the drive means, i.e. the pulley 50 through the end 34. When a diamond disk (not shown) mounted to the conditioning disk 54 must be replaced, it is a time consuming and labor intensive task. A technician must first remove a pad conditioner cover (not shown), shift the pad conditioner arm outside the polishing machine, remove the pad conditioner belt, disconnect the pneumatic pipe 52 and then remove a worn diamond disk. Since the conditioning disk 54 can only be dropped to a short distance, i.e. to an engagement position with a polishing pad, there is little space to access the mounting screws for the diamond disk which complicates the disk removal procedure.

It is therefore an object of the present invention to provide an apparatus of a quick coupler for mounting a rotational disk that does not have the drawbacks or shortcoming of the conventional mounting apparatus.

It is another object of the present invention to provide a quick coupler for the quick connect/disconnect of a rotational disk to/from a travel housing when a diamond disk on the rotational disk needs to be replaced.

It is a further object of the present invention to provide a quick coupler for mounting a rotational disk into a pad conditioner disk holder that can be quickly disconnected by disengaging a plurality of jutting keys from a disk holder.

It is another further object of the present invention to provide a quick coupler for mounting a rotational disk that does not require the removal of screws when a diamond disk must be removed from the rotational disk.

It is still another object of the present invention to provide a quick coupler for mounting a rotational disk into a pad conditioner disk holder wherein the rotational disk can be removed by a simple retraction of a retractable ring situated on a travel housing.

It is yet another object of the present invention to provide a pad conditioner disk holder assembly that includes a drive means, a rotational disk, a disk holder and a travel housing.

SUMMARY OF THE INVENTION

In accordance with the present invention, a quick coupler for the quick connect/disconnect of a rotational disk into a pad conditioner disk holder is provided.

In a preferred embodiment, a quick coupler for mounting a rotational disk is provided which includes a disk holder of a ring shape having a center aperture formed in a polygon, each side of the polygon is provided with a spring-loaded steel ball and a recessed slot behind each ball adapted for receiving a jutting key situated on and operated by a retractable ring attached to a travel housing, the disk holder is further provided with a planar surface for releasably engaging a rotational disk thereon by mechanical means; and a travel housing of cylindrical shape that has a first end threaded for engaging a drive means and a second end in the polygon shape for intimately engaging the center aperture of the disk holder for transmitting a rotational motion of the drive means, the second end is further provided with a spring-loaded retractable ring for sliding in a longitudinal direction of the travel housing and for operating a plurality of jutting keys attached thereon such that when the second end is pushed into the center aperture of the disk holder, each of the plurality of jutting keys engages one of the steel balls by pushing the balls radially inward in a locked position into a hemispherical recess provided in a flat surface of the polygon-shaped second end of the travel housing.

In the quick coupler for mounting a rotational disk, the center aperture may be formed in a polygon that has at least six sides, or formed in an octagon. The disk holder may further be provided with a recessed slot along an outer peripheral surface of the holder adapted for receiving a retaining ring therein for retaining the steel balls in the holder. The rotational disk may have attached thereon a diamond disk for conditioning a polishing pad. The plurality of jutting keys may be eight jutting keys when the center aperture is formed in an octagon. The mechanical means for engaging the rotational disk to the planar surface of the disk holder may be a plurality of bolts. The drive means may be a pulley and a belt that are connected to a motor driven pulley.

The present invention is further directed to a pad conditioner disk holder assembly that includes a drive means for providing rotational motion to the assembly; a rotational disk for attaching to a disk holder; a disk holder of a ring shape that has a center aperture formed in a polygon, each side of the polygon is provided with a spring-loaded steel ball and a recessed slot behind each ball adapted for receiving a jutting key situated on and operated by a retractable ring attached to a travel housing, the disk holder is further provided with a planar surface for releasably engaging the rotational disk thereon by mechanical means; and a travel housing of cylindrical shape that has a first end threaded for engaging the drive means and a second end in the polygon shape for intimately engaging the center aperture of the disk holder for transmitting a rotational motion of the drive means, the second end is further provided with a spring-loaded retractable ring for sliding in a longitudinal direction of the travel housing and for operating a plurality of jutting keys attached thereon, such that when the second end is pushed into the center aperture of the disk holder each of the plurality of jutting keys engages one of the steel balls by pushing the balls radially inward in a locked position into a hemispherical recess provided in a flat surface of the polygon-shaped second end of the travel housing.

In the pad conditioner disk holder assembly, the drive means may be a pulley and a belt which are connected to a motor driven second pulley. The mechanical means for engaging the rotational disk to the planar surface of the disk holder may be a plurality of screws. The center aperture may be formed in a polygon shape that has at least five sides, or may be formed in a hexagon or octagon. The plurality of jutting keys may be between five and ten jutting keys when the center aperture is formed in a polygon that has between five and ten sides. The rotational disk may have a diamond disk attached thereon for conditioning a polishing pad in a chemical mechanical polishing apparatus.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENTS

Figure 1A:
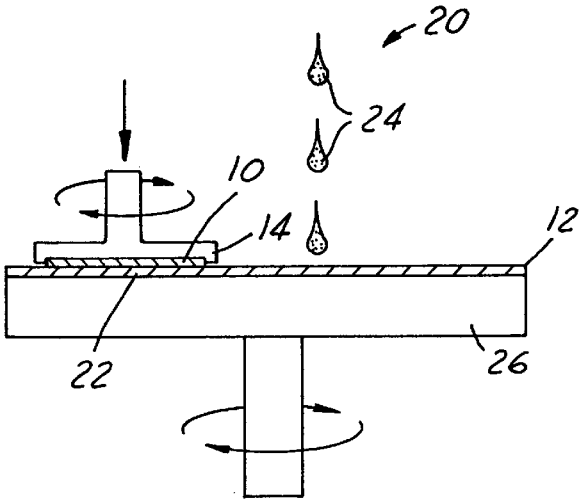
FIG. 1A is a cross-sectional view illustrating a conventional chemical mechanical polishing apparatus.
Figure 1B:
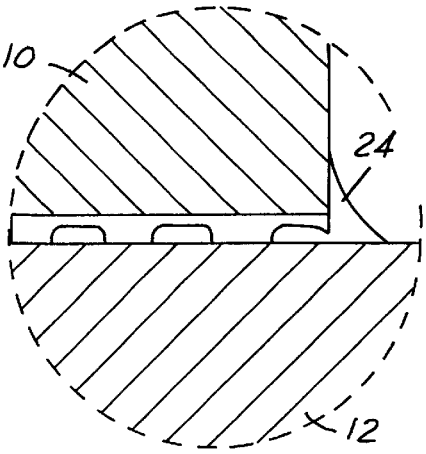
FIG. 1B is a partial, enlarged, cross-sectional view showing the slurry interaction between a wafer surface and a polishing pad.
Figure 1C:
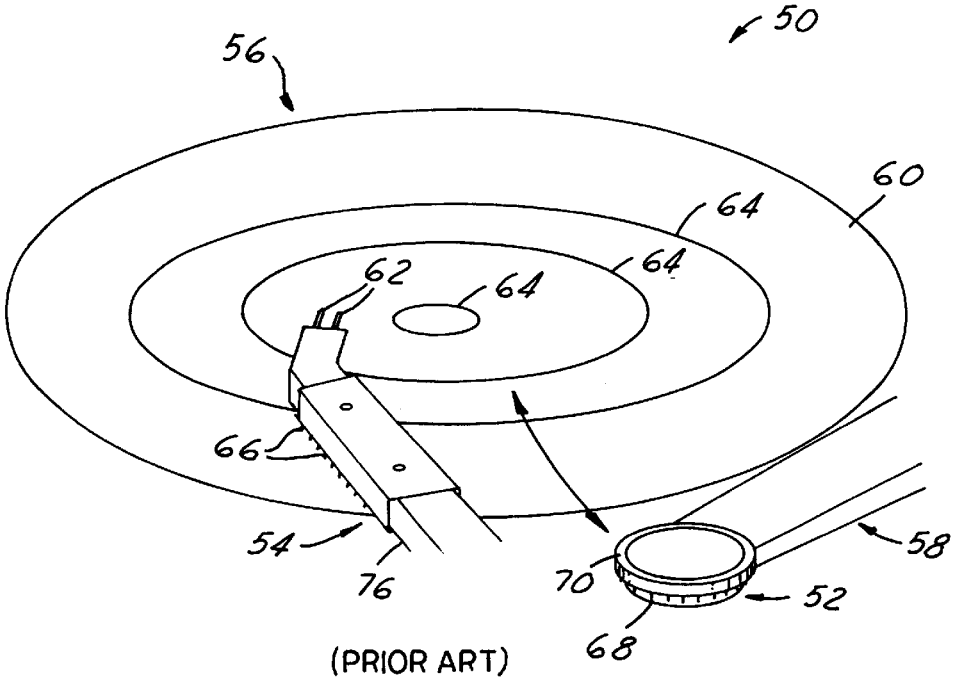
(PRIOR ART) FIG. 1C
FIG. 1C is a perspective view of a polishing pad with a conditioning head positioned on top.
Figure 2:
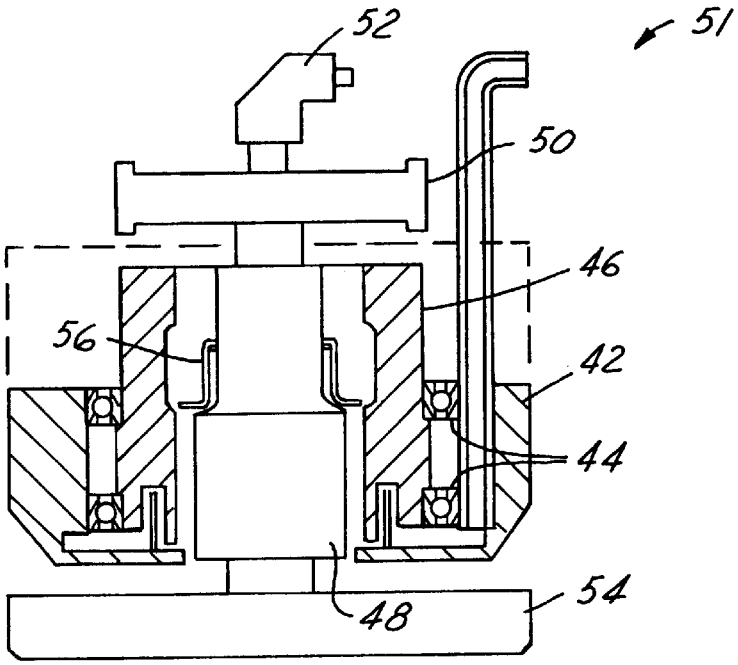
(PRIOR ART) FIG. 2
FIG. 2 is a cross-sectional view of a conventional conditioning head of FIG. 1C.
Figure 3:
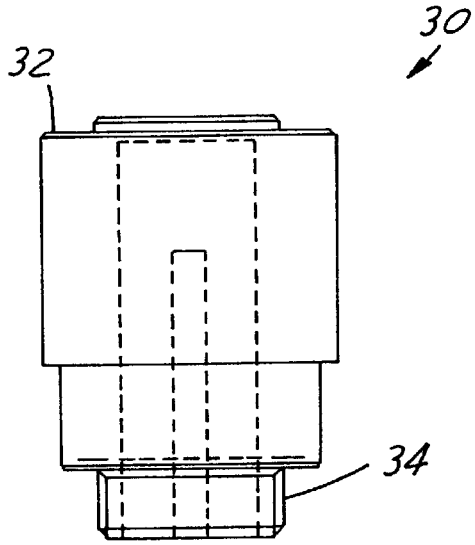
(PRIOR ART) FIG. 3
FIG. 3 is a side view of a conventional travel housing utilized in a pad conditioner disk holder.

The present invention discloses a quick coupler for the quick connect/disconnect of a rotational disk to or from a pad conditioner disk holder. The quick coupler consists of two major components of a disk holder and a travel housing.

The disk holder of the quick coupler can be formed in a ring shape that has a center aperture of a polygon shape. Each side of the polygon is provided with a spring-loaded steel ball and a recessed slot behind the ball adapted for receiving a jutting key situated on and operated by a retractable ring that is attached to a travel housing onto which the disk holder is to be engaged. The disk holder has a planar surface for releasably engaging a rotational disk by mechanical means such as a plurality of bolts or screws.

The travel housing of the quick coupler is formed of cylindrical shape that has a first end threaded for engaging a drive means and a second end formed in the same polygon shape as the center aperture of the disk holder for intimately engaging the latter such that a rotational torque of the drive means can be transmitted from the travel housing to the disk holder. The second end is further provided with a spring-loaded retractable ring for slidingly engaging the travel housing in a longitudinal direction and for operating a plurality of jutting keys attached thereon so that when the second end is pushed into the center aperture of the disk holder each of the plurality of jutting keys engages one of the steel balls by pushing the balls radially inward in a locked position into a hemispherical recess provided in a flat surface of the polygon-shaped second end of the travel housing.

The invention further provides a head conditioner disk holder assembly that is constructed by a drive means, a rotational disk, a disk holder and a travel housing. The drive means provides rotational motion or torque to the assembly, while the rotational disk contains a diamond disk mounted thereon for attaching to the disk holder.

The present invention novel apparatus can be modified from a conventional travel housing by first machining the bottom of the travel housing from an original diameter size to a smaller size, and then from a circular cross-section into a polygon cross-section such that a rotational torque can be transmitted from the travel housing to a disk holder. A retractable ring equipped with a plurality of jutting keys is then slidingly mounted to the travel housing and spring-loaded such that it can be retracted while under spring tension. A disk holder, in a ring shape, is provided which has an inner polygon aperture for fitting to the polygon-shaped bottom end of the travel housing with a plurality of steel balls for locking to the travel housing when the balls are engaged by the jutting keys. To disengage the disk holder from the travel housing of the present invention, the retractable ring may be pulled such that the plurality of jutting keys disengages from the steel balls in the disk holder, thus unlocking the disk holder from the travel housing. The two parts of the travel housing and the disk holder can be easily separated to allow easy access to a rotational disk mechanically mounted on the disk holder.

Figure 4:
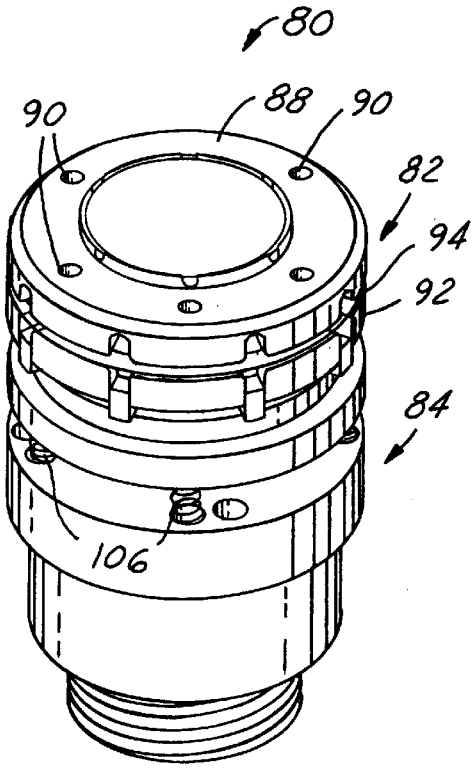
FIG. 4 is a perspective view of the present invention quick coupler with the disk holder engaged to the travel housing.
Figure 5:
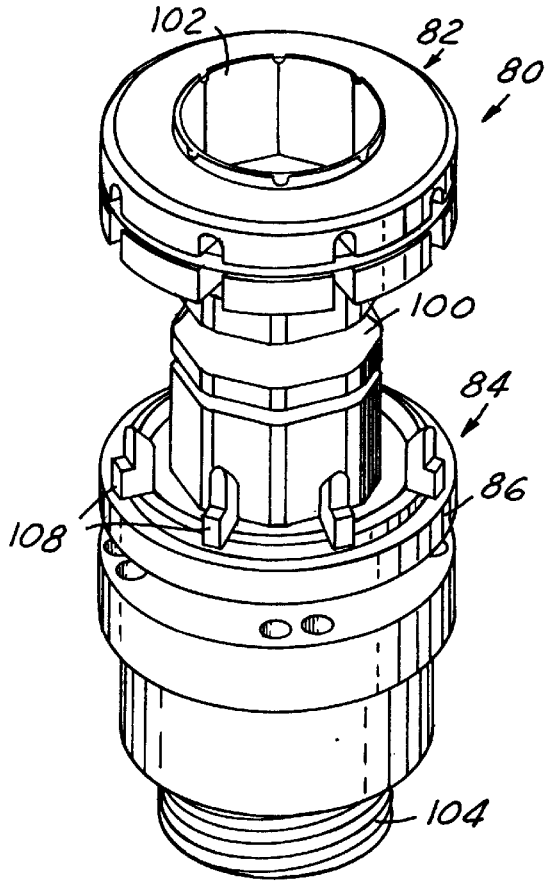
FIG. 5 is the present invention quick coupler of FIG. 4 with the disk holder disengaged from the travel housing.
Figure 6:
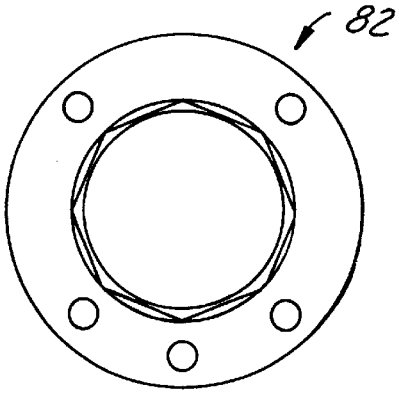
FIG. 6 is a plane view of the planar bottom surface of the disk holder.
Figure 7:
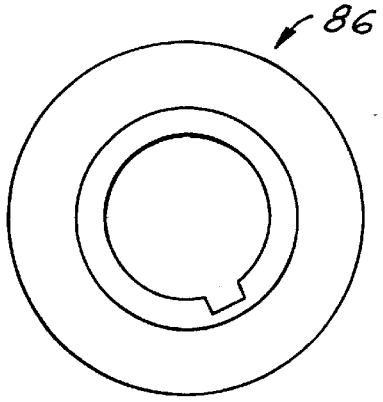
FIG. 7 is a plane view of the retractable ring of the present invention travel housing.

Referring now to FIG. 4, wherein a present invention quick coupler 80 is shown. The quick coupler 80 consists of two major components, i.e. a disk holder 82 and a travel housing 84. FIG. 4 illustrates a condition wherein the disk holder 82 is locked onto the travel housing 84, while FIG. 5 illustrates a condition wherein the two parts are disengaged from each other. A plane view of the disk holder 82 is further shown in FIG. 6, while a plane view of a retractable ring 86 is shown in FIG. 7.

As shown in FIGS. 4~7, a planar top surface 88 on the disk holder 82 is used to engage a rotational disk (not shown) by mechanical means, i.e. such as by a plurality of bolts through the bolt holes 90. The disk holder 82 is further provided, in an outer peripheral surface 92, a recessed slot 94 for engaging a retaining ring 96 (shown in FIG. 10). The retainer ring 96 is used to retain steel balls 98 which are provided for locking the second end 100 of the travel housing 84 to the disk holder 82.

As shown in FIG. 5, the center aperture 102 of the disk holder 82 is provided with a polygon that is an octagon for transmitting a rotational torque from the travel housing 84.

Figure 8:
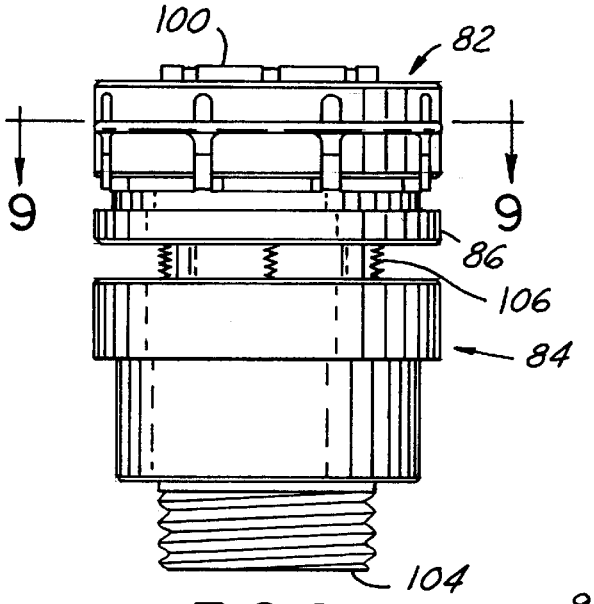
FIG. 8 is a side view of the present invention quick coupler with the disk holder engaged to the travel housing.
Figure 9:
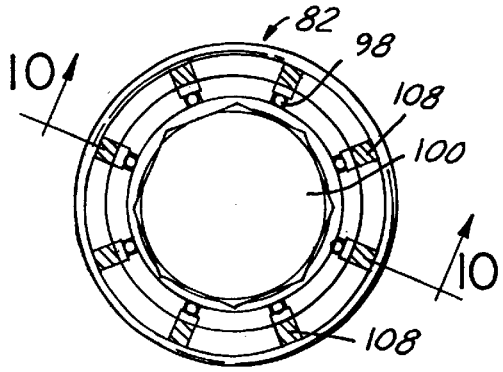
FIG. 9 is a plane view of the quick coupler of FIG. 8 with the disk holder engaged to the travel housing.
Figure 10:
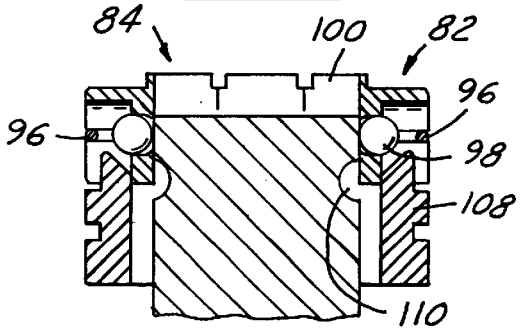
FIG. 10 is a partial, cross-sectional view of the present invention quick coupler with the jutting keys disengaged from the steel balls in an unlocked position.
Figure 11:
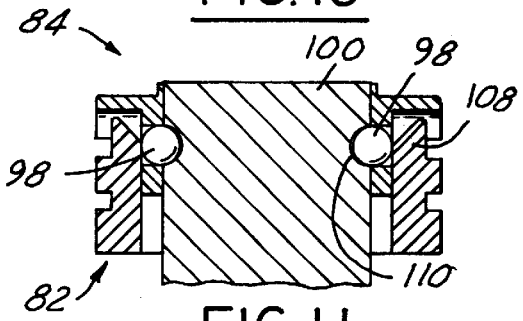
FIG. 11 is a partial, cross-sectional view of the present invention quick coupler with the jutting keys engaging the steel balls in a locked position.

A detailed structure of the travel housing 84 is shown in FIG. 5. It is seen that the travel housing 84 is constructed of a cylindrical shape that has a first end 104 threaded for engaging a drive means (not shown), a second end 100 that is formed in a polygon shape similar to the polygon in the center aperture 102 of the disk holder 82. The matching polygon shape thus enables a transfer of rotational torque or motion from the travel housing 84 to the disk holder 82 by an intimate engagement between the two parts. The travel housing 84 is further equipped with a retractable ring 86 that is slidably mounted in the longitudinal direction of the travel housing 84. The retractable ring 86 is spring-loaded by a plurality of springs 106 (shown in FIG. 4) such that a plurality of jutting keys 108 may be extended in a locked position when the travel housing 84 and the disk holder 82 are in an engaged position. The springs 106 further enable the retractable ring 86 to be pulled back toward the first end 104 when the disk holder 82 is to be disengaged from the travel housing 84. Each of the plurality of jutting keys 108 engages a steel ball 98 when the second end 100 is pushed into the center aperture 102 of the disk holder 82, as shown in FIG. 10. When the plurality of jutting keys 108 are fully inserted into the disk holder 82, as shown in FIG. 11, the steel balls 98 are pushed into a locked position by engaging a hemispherical recess 110 provided in an outer peripheral surface of the second end 100 of the travel housing 84. A cross-sectional view taken along line 9—9 of FIG. 8 is shown in FIG. 9 of an engaged position between the disk holder 82 and the travel housing 84. Similarly, FIG. 10 illustrates a cross-sectional view taken along line 10—10 shown in FIG. 9.

The present invention quick coupler for mounting a rotational disk for the quick connect/disconnect to/from a pad conditioner disk holder has therefore been amply described in the above description and in the appended drawings of FIGS. 4~11.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A quick coupler for mounting a rotational disk comprising:

a disk holder of a ring shape having a center aperture formed in a polygon, each side of the polygon being provided with a spring-loaded steel ball and a recessed slot behind each ball adapted for receiving a jutting key situated on and operated by a retractable ring attached to a travel housing, said disk holder being further provided with a planar surface for releasably engaging a rotational disk thereon by mechanical means; and a travel housing of cylindrical shape having a first end threaded for engaging a drive means and a second end in said polygon shape for intimately engaging said center aperture of said disk holder for transmitting a rotational motion of said drive means, said second end being further provided with a spring-loaded retractable ring for sliding in a longitudinal direction of said travel housing and for operating a plurality of jutting keys attached thereon such that when said second end being pushed into said center aperture of the disk holder each of said plurality of jutting keys engages one of said steel balls by pushing the balls radially inward in a locked position into a hemispherical recess provided in a flat surface of said polygon-shaped second end of the travel housing.

2. A quick coupler for mounting a rotational disk according to claim 1, wherein said center aperture being formed in a polygon having at least six sides.

3. A quick coupler for mounting a rotational disk according to claim 1, wherein said center aperture being formed in a octagon.

4. A quick coupler for mounting a rotational disk according to claim 1, wherein said disk holder further being provided with a recessed slot along an outer peripheral surface of the holder adapted for receiving a retaining ring therein for retaining said steel balls in said holder.

5. A quick coupler for mounting a rotational disk according to claim 1, wherein said rotational disk having attached thereon a diamond disk for conditioning a polishing pad.

6. A quick coupler for mounting a rotational disk according to claim 1, wherein said plurality of jutting keys being eight jutting keys when said center aperture is formed in an octagon.

7. A quick coupler for mounting a rotational disk according to claim 1, wherein said mechanical means for engaging said rotational disk to said planar surface of the disk holder is a plurality of bolts.

8. A quick coupler for mounting a rotational disk according to claim 1, wherein said drive means being a pulley and a belt that are connected to a motor driven pulley.

9. A pad conditioner disk holder assembly comprising:

a drive means for providing rotational motion to said assembly;

a rotational disk for attaching to a disk holder;

said disk holder of a ring shape having a center aperture formed in a polygon, each side of said polygon being provided with a spring-loaded steel ball and a recessed slot behind each ball adapted for receiving a jutting key situated on and operated by a retractable ring attached to a travel housing, said disk holder being further provided with a planar surface for releasably engaging said rotational disk thereon by mechanical means; and a travel housing of cylindrical shape having a first end threaded for engaging said drive means and a second end in said polygon shape for intimately engaging said center aperture of said disk holder for transmitting a rotational motion of said drive means, said second end being further provided with a spring-loaded retractable ring for sliding in a longitudinal direction of said travel housing and for operating a plurality of jutting keys attached thereon such that when said second end being pushed into said center aperture of the disk holder each of said plurality of jutting keys engages one of said steel balls by pushing the balls radially inward in a locked position into a hemispherical recess provided in a flat surface of said polygon-shaped second end of the travel housing.

10. A pad conditioner disk holder assembly according to claim 9, wherein said drive means being a pulley and a belt that are connected to a motor driven pulley.

11. A pad conditioner disk holder assembly according to claim 9, wherein said mechanical means for engaging said rotational disk to said planar surface of the disk holder is a plurality of bolts.

12. A pad conditioner disk holder assembly according to claim 9, wherein said center aperture being formed in a polygon having at least six sides.

13. A pad conditioner disk holder assembly according to claim 9, wherein said center aperture being formed in a octagon.

14. A pad conditioner disk holder assembly according to claim 9, wherein said plurality of jutting keys being eight jutting keys when said center aperture is formed in an octagon.

15. A pad conditioner disk holder assembly according to claim 9, wherein said rotational disk having attached thereon a diamond disk for conditioning a polishing pad.

16. A pad conditioner disk holder assembly according to claim 9, wherein said disk holder further being provided with a recessed slot along an outer peripheral surface of the holder adapted for receiving a retaining ring therein for retaining said steel ball in said holder.

* * * * *